US009465360B2

(12) United States Patent
Aoki et al.

(10) Patent No.: US 9,465,360 B2
(45) Date of Patent: Oct. 11, 2016

(54) FIXING DEVICE

(71) Applicant: CANON KABUSHIKI KAISHA, Tokyo (JP)

(72) Inventors: Kota Aoki, Toride (JP); Koji Nojima, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/870,656

(22) Filed: Sep. 30, 2015

(65) Prior Publication Data

US 2016/0098009 A1 Apr. 7, 2016

(30) Foreign Application Priority Data

Oct. 6, 2014 (JP) ..... 2014-205610

(51) Int. Cl.
*G03G 21/20* (2006.01)
*G03G 15/20* (2006.01)

(52) U.S. Cl.
CPC ..... *G03G 21/206* (2013.01); *G03G 15/20* (2013.01); *G03G 15/2017* (2013.01); *G03G 15/2042* (2013.01); *G03G 15/2053* (2013.01)

(58) Field of Classification Search
None
See application file for complete search history.

(56) References Cited

U.S. PATENT DOCUMENTS

| | | | | |
|---|---|---|---|---|
| 7,589,300 | B2 | 9/2009 | Nojima | |
| 8,139,995 | B1 | 3/2012 | Fujita et al. | |
| 9,152,097 | B2 | 10/2015 | Nojima et al. | |
| 2007/0177895 | A1* | 8/2007 | Yano | G03G 21/20 399/122 |
| 2008/0038008 | A1 | 2/2008 | Fujita et al. | |
| 2008/0050155 | A1* | 2/2008 | Miki | G03G 15/2064 399/328 |
| 2008/0056755 | A1* | 3/2008 | Koshida | G03G 15/2039 399/92 |
| 2012/0328323 | A1 | 12/2012 | Murooka | |
| 2014/0086617 | A1 | 3/2014 | Nojima | |
| 2014/0178091 | A1 | 6/2014 | Sugiyama et al. | |
| 2015/0063858 | A1 | 3/2015 | Nakamura et al. | |
| 2015/0086234 | A1 | 3/2015 | Aoki | |
| 2015/0268596 | A1 | 9/2015 | Nojima et al. | |
| 2015/0268605 | A1 | 9/2015 | Nojima et al. | |

FOREIGN PATENT DOCUMENTS

| | | | |
|---|---|---|---|
| JP | 4-44075 | A | 2/1992 |
| JP | 2008-298831 | A | 12/2008 |
| WO | 2013/137299 | A1 | 9/2013 |

OTHER PUBLICATIONS

Search Report issued in European Patent Application No. 15186383.4, dated Mar. 7, 2016.

* cited by examiner

*Primary Examiner* — David Gray
*Assistant Examiner* — Thomas Giampaolo, II
(74) *Attorney, Agent, or Firm* — Fitzpatrick, Cella, Harper & Scinto

(57) ABSTRACT

A fixing device includes: first and second rotatable members configured to fix, at a nip therebetween, a toner image formed on a sheet by using a toner containing a parting agent; a casing provided with a sheet introducing opening and a sheet discharging opening and configured to include the first and second rotatable members; a fan; a duct configured to guide air from the fan toward one longitudinal end portion of the first rotatable member; and a cover member configured to cover an outer surface of the first rotatable member. The cover member extends inside the casing from a neighborhood of the sheet introducing opening to the duct.

9 Claims, 12 Drawing Sheets

FIXING DEVICE

FIELD OF THE INVENTION AND RELATED ART

The present invention relates to a fixing device for fixing a toner image on a sheet. This fixing device is mountable in an image forming apparatus such as a copying machine, a printer, a facsimile machine or a multi-function machine having a plurality of functions of these machines.

In a conventional image forming apparatus of an electrophotographic type, the toner image is formed on the sheet by using a toner in which a parting agent (wax) is incorporated, and then is fixed under heat and pressure in the fixing device.

It has been known that during the fixing, the wax incorporated in the toner is vaporized and immediately thereafter is condensed. According to knowledges of the present inventors, it has been found that in the neighborhood of a fixing member of the fixing device, the condensed wax (particles of several nm to several hundred nm, hereinafter referred to as also a dust) is present and suspended in a large amount. When no means is taken against such a wax immediately after the condensation, most of the wax is diffused to an outside of the fixing device, so that there is a liability that an image is adversely affected. Therefore, it has been required that the wax immediately after the condensation is increased in particle diameter so as not to be diffused to the outside of the fixing device.

In the case where a sheet having a small width size is continuously subjected to a fixing process, a region of the fixing member which does not contact the sheet causes overheating in some cases. This is because the fixing member partly accumulates heat corresponding to an amount of no heat dissipation by contact with the sheet.

As a countermeasure thereagainst, in a fixing device disclosed in Japanese Laid-Open Patent Application 2008-298831, a constitution in which air is blown by a fan onto a region, where there is a liability of overheating, at end portions of a fixing member with respect to a longitudinal direction of the fixing member is employed.

However, in the case of such a fixing device, the dust actively diffuses to an outside of the fixing device, so that a countermeasure thereagainst has been required.

SUMMARY OF THE INVENTION

According to an aspect of the present invention, there is provided a fixing device comprising: first and second rotatable members configured to fix, at a nip therebetween, a toner image formed on a sheet by using a toner containing a parting agent; a casing provided with a sheet introducing opening and a sheet discharging opening and configured to include the first and second rotatable members; a fan; a duct configured to guide air from the fan toward one longitudinal end portion of the first rotatable member; and a cover member configured to cover an outer surface of the first rotatable member, wherein the cover member extends inside the casing from a neighborhood of the sheet introducing opening to the duct.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiments of a fixing device according to the present invention will be specifically described below. Incidentally, unless otherwise specified, within a scope of concept of the present invention, constitutions of various devices can be replaced with other constitutions.

<Embodiment>

(1) General Structure of Image Forming Apparatus

Figure 4:
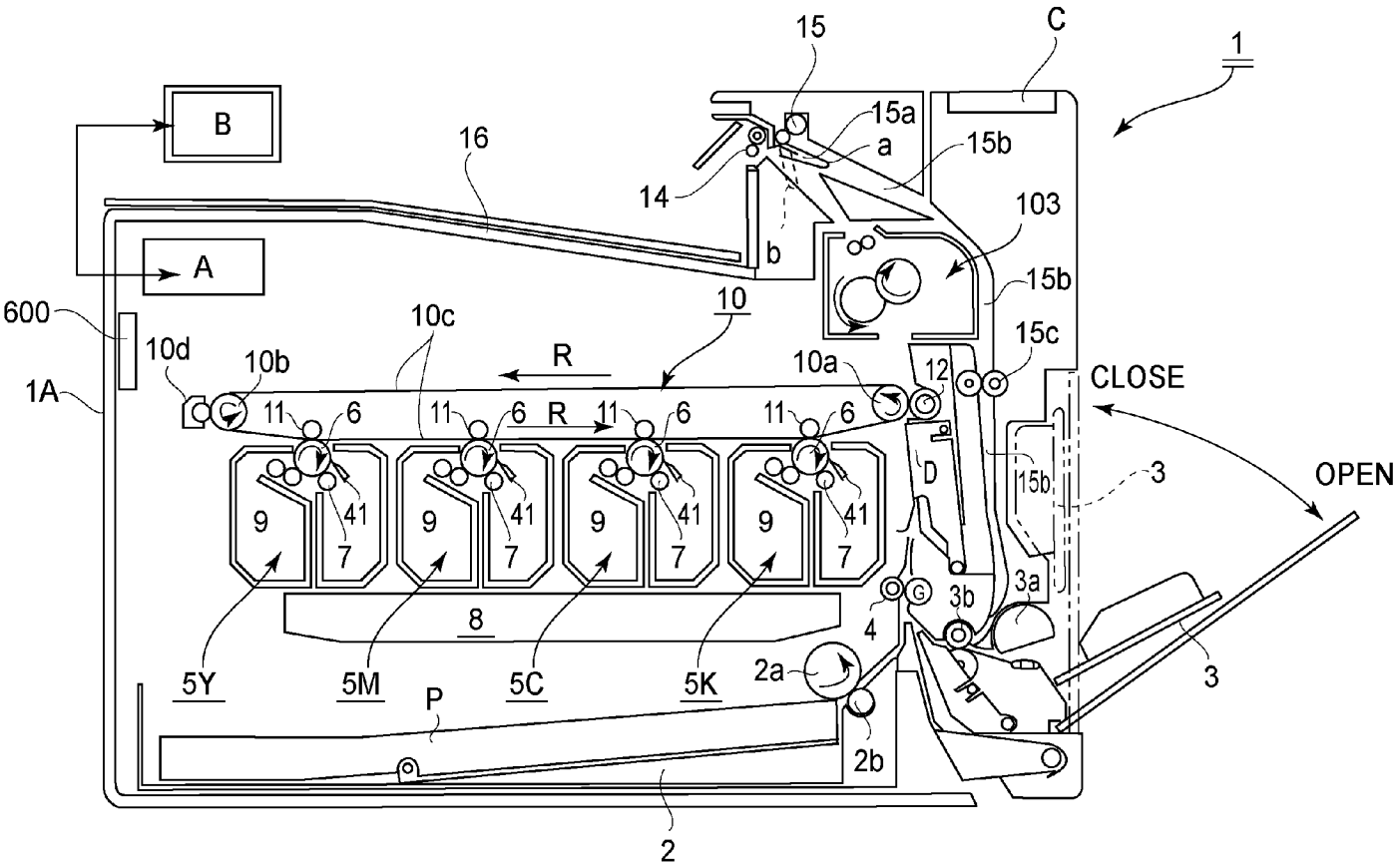
FIG. 4 is a schematic sectional view of an image forming apparatus in Embodiment.

FIG. 4 is a schematic sectional view showing a general structure of an image forming apparatus 1 in this embodiment. This image forming apparatus 1 is a four color-basis full-color electrophotographic laser beam printer, and forms a toner image on a sheet P on the basis of an electric image signal inputted from an external host device B such as a personal computer or an image reader into a control circuit portion A. The sheet P is a sheet-like recording medium (recording material) capable of forming the toner image, and examples of the sheet P may include plain paper, an OHP sheet, coated paper, label paper and the like.

The control circuit portion A transfers various pieces of electric information between itself and the external host device B or an operating portion C, and effects integrated control of an image forming operation of the image forming apparatus 1 in accordance with predetermined control program and reference table.

The image forming apparatus includes first to fourth (four) image forming portions 5 (Y, M, C, K) which are successively arranged in parallel from a left side to a right side in FIG. 4 at a substantially central portion of an inside of an apparatus main assembly 1A.

Each image forming portion 5 is the same electrophotographic process mechanism, and includes a drum-type electrophotographic photosensitive member (hereinafter referred to as a "drum") 6 rotated in the clockwise direction of an arrow at a predetermined peripheral speed. As electrophotographic process means actable on the drum 6, a charging roller 7, a developing unit 9, and a cleaning member 41 are provided.

Below the respective image forming portions 5, a laser scanner unit 8 as an image information exposure means for the respective drums 6 is provided. On the respective image forming portions 5, an intermediary transfer belt unit 10 including a driving roller 10*a*, a tension roller 10*b*, and an intermediary transfer belt (hereinafter referred to as a belt) 10*c* extended and stretched between these rollers. The belt 10*c* is rotated and moved in the counterclockwise direction of an arrow R at a predetermined peripheral speed.

Inside the belt 10*c*, primary transfer rollers 11 opposing the drums 6 of the respective image forming portions 5 are provided. An upper surface portion of each of the drums 6 of the image forming portions 5 contacts a lower surface of the belt 10*c* in a position of the associated primary transfer roller 11. The contact portion is a primary transfer portion. Outside a curved portion of the belt 10*c* contacting the driving roller 10*a*, a secondary transfer roller 12 is provided. A contact portion between the belt 10*c* and the secondary transfer roller 12 is a secondary transfer portion. Outside a curved portion of the belt 10*c* contacting the tension roller 10*b*, a transfer belt cleaning device 10*d* is provided.

A Y toner image corresponding to a Y (yellow) color component of a full-color image is formed on the drum 6 of the first image forming portion 5Y by an electrophotographic process. The toner image is primary-transferred onto the belt 10*c* at the primary transfer portion of the image forming portion 5Y. An M toner image corresponding to an M (magenta) color component of the full-color image is formed on the drum 6 of the second image forming portion 5M. The toner image is primary-transferred superposedly onto the Y toner image which has already been transferred on the belt 10*c* at the primary transfer portion of the image forming portion 5M.

A C toner image corresponding to a C (cyan) color component of the full-color image is formed on the drum 6 of the third image forming portion 5C. The toner image is primary-transferred superposedly onto the Y+M toner images which have already been transferred on the belt 10*c* at the primary transfer portion of the image forming portion 5C. A K toner image corresponding to a K (black) color component of the full-color image is formed on the drum 6 of the fourth image forming portion 5K. The toner image is primary-transferred superposedly onto the Y+M+C toner images which have already been transferred on the belt 10*c* at the primary transfer portion of the image forming portion 5K.

On the other hand, one of sheets P in a cassette 2 is fed by a feeding roller 2*a* and a retard roller 2*b* at predetermined control timing to a registration roller pair 4 positioned in a sheet feeding path (vertical path) D. In the case of an operation in a manual feeding mode, the sheet P on a manual feeding tray 3 is sent out by a feeding roller 3*a* and is caused to enter the feeding path D by a feeding roller pair 3*b* to be fed to the registration roller pair 4. The manual feeding tray 3 is capable of being placed in a closed state (retracted state) in which the manual feeding tray 3 is vertically raised and folded with respect to the apparatus main assembly 1A as indicated by a chain double-dashed line during non-use. During use, the manual feeding portion 3 is turned on its side as indicated by a solid line to be placed in an open state.

In the image forming apparatus 1 in this embodiment, feeding of the sheet P in the apparatus is made on the basis of a center(-line) basis feeding. This sheet feeding is in the form in which even any width sheet usable (passable) in the apparatus is passed so that a width with center line of the sheet is aligned with a width with center line of the sheet feeding path.

The sheet P is fed to the secondary transfer portion at predetermined control timing by the registration roller pair 4, and in a process in which the sheet P is nipped and fed at the secondary transfer portion, the superposed four color toner images on the belt 10*c* are collectively secondary-transferred onto the surface of the sheet P. The sheet P coming out of the secondary transfer portion is separated from the belt 10*c* to be fed into a fixing device 103, and then the toner images are thermally fixed on the sheet P. In an operation in a one-side printing mode, the sheet P coming out of the fixing device 103 passes through a lower side of a double-side flapper 15*a* held in a first attitude a indicated by a solid line, and then is discharged onto the discharge tray 16 by the discharging roller pair 14.

In the case of an operation in a double-side printing mode, the sheet P, coming out of the fixing device 103, which has already been subjected to image formation at its one surface passes through an upper side of the double-side flapper 15*a* switched to a second attitude b indicated by a broken line, and then is fed toward the discharge tray 16 by a switch-back roller 15. Then, when a downstream end of the sheet P with respect to a feeding direction reaches a position on the double-side flapper 15*a*, the double-side flapper 15*a* is returned to the first attitude a, and at the same time, the switch-back roller 15 is reversely driven.

As a result, the sheet P is reversely fed downward in the re-circulating path 15*b* to the registration roller pair 4 again via a feeding roller pair 15*c* and 3*b*. Thereafter, similarly as in the case of an operation in a one-side image forming mode, the sheet P which has already subjected to the double-side printing is fed through a path including the secondary transfer portion, the fixing device 103 and the discharging roller pair 14, thus being discharged onto the discharge tray 16.

(2) Structure of Fixing Device

Figure 1A:
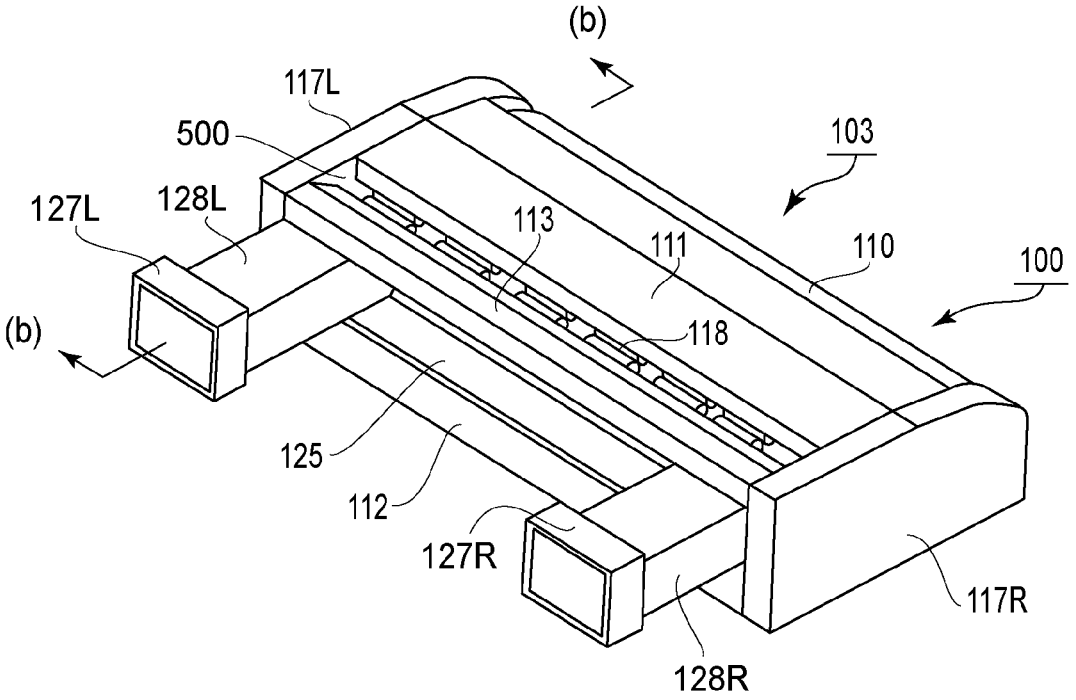
FIG. 1A is a perspective view at an outer appearance of a fixing device in Embodiment.
Figure 1B:
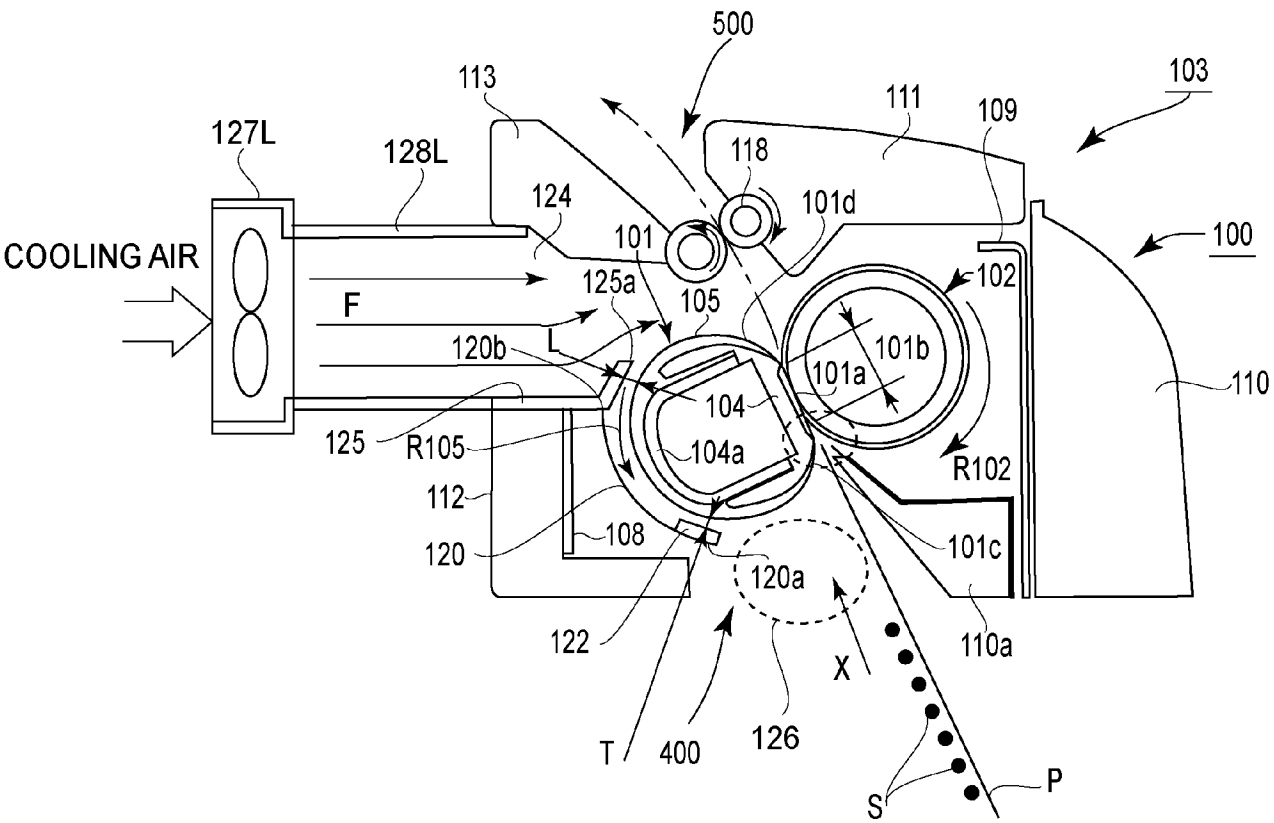
FIG. 1B is a schematic sectional view of the fixing device at a position of (b)-(b) line in FIG. 1A.
Figure 2:
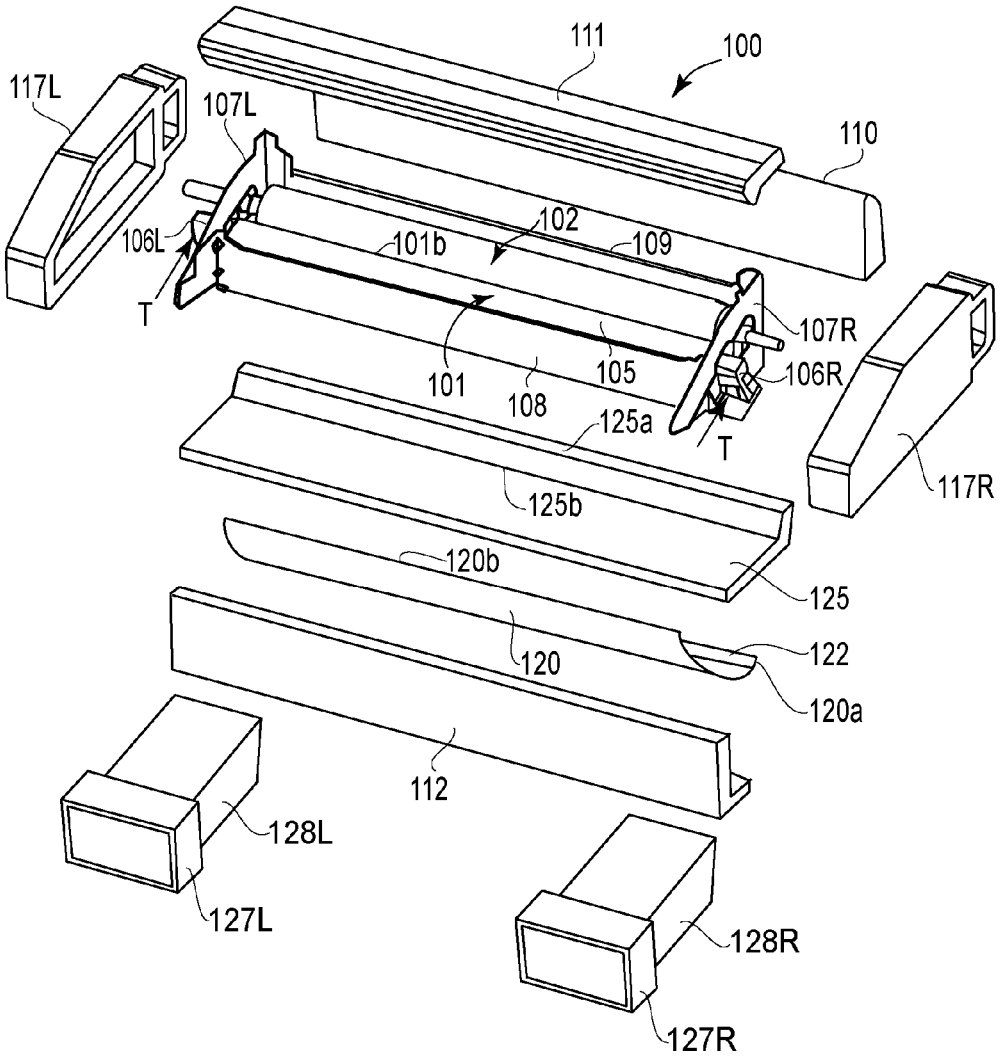
FIG. 2 is an exploded perspective view of a fixing device.

Next, the fixing device 103 will be described. FIG. 1A is a perspective view of an outer appearance of the fixing device 103 in this embodiment, and FIG. 1B is a schematic sectional view of the fixing device 103 at a position of (b)-(b) line in FIG. 1A. FIG. 2 is an exploded perspective view of the fixing device 103. The fixing device in this embodiment is constituted by pair of rotatable members (first rotatable member, second rotatable member) 105, 102 between which a nip 101*b* for heating and pressing the sheet P while nipping and feeding the sheet P is formed. For example, the fixing device 103 is a fixing device of a belt (film) heating type using a planar (thin plate-like) heater 101*a* such as a ceramic heater as a heating source. The fixing device of this type has been known by Japanese Laid-Open Patent Application (JP-A) Hei 4-44075 and the like, for example.

Figure 8:
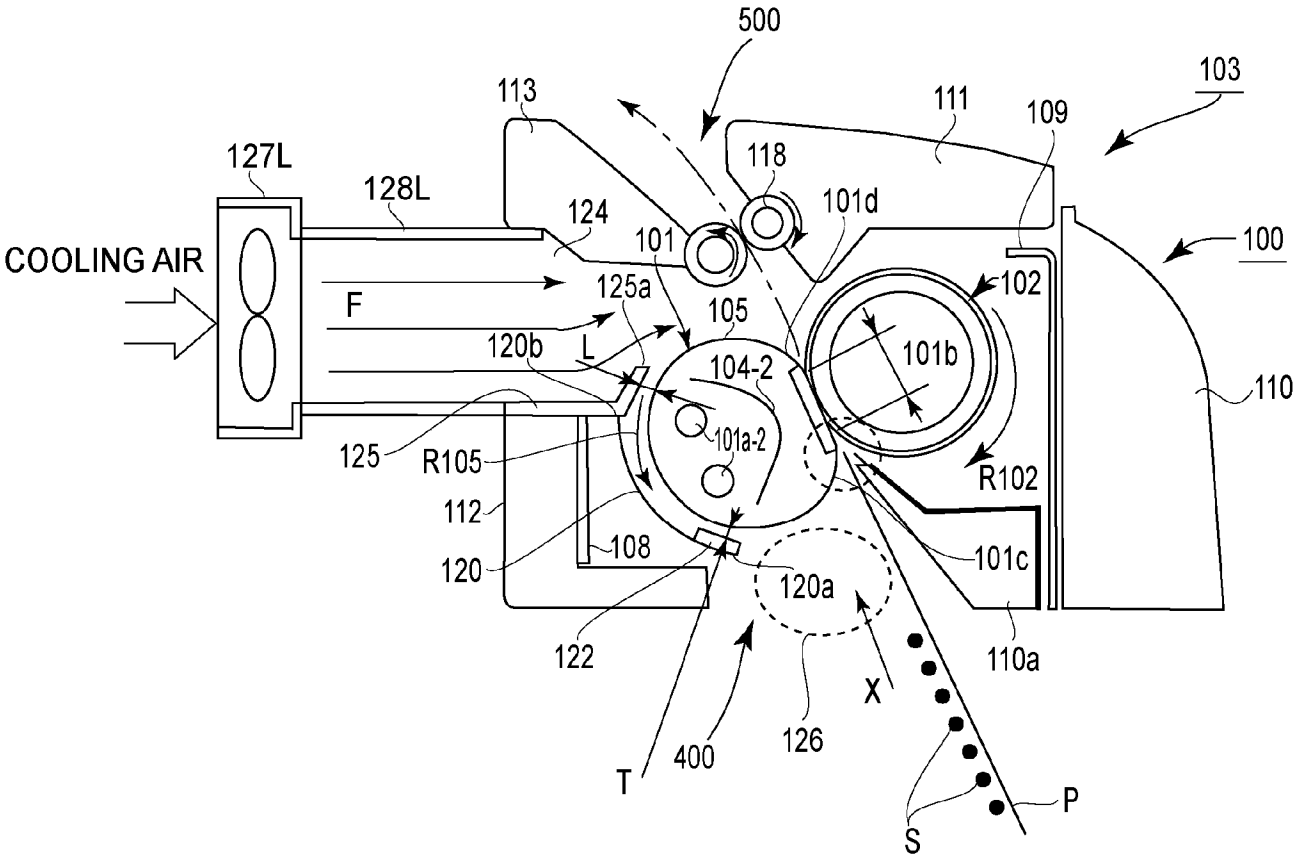
FIG. 8 is a schematic sectional view of the fixing device.

FIG. 8 is a schematic sectional view of the fixing device 103 in another embodiment. As shown in FIG. 8, the fixing device 103 is of the belt (film) heating type in which a halogen heater 101*a*-2 and a reflection plate 104-2 are provided. A heating device (apparatus) of this type has been known by JP-A 2013-195683, for example.

The fixing device 103 is an apparatus such that a direction parallel to a direction perpendicular to a feeding direction (sheet feeding direction) X of the sheet P in a plane of a sheet feeding path at a nip 101*b* is a longitudinal direction (widthwise direction). The fixing device 103 roughly includes a heating unit 101 including a fixing belt 105, a fixing unit including a pressing roller (pressing member) 102, and a casing 100 accommodating these units. The fixing belt 105 is the first rotatable member capable of contacting a surface of the sheet P on which an unfixed toner image S is formed. The pressing roller 102 is the second rotatable member capable of contacting a surface, of the sheet P, opposite from the surface on which the unfixed toner image S is formed.

(2-1) Structure of Casing

In the casing 100, as shown in FIG. 1B, an introducing opening (sheet introducing opening) 400 is formed at a portion where the sheet P is introduced, and a discharging (sheet opening discharging opening) 500 is formed at a portion where the sheet P is discharged.

The casing 100 is provided with an opening 124 through which air F passes from fans 127L, 127R provided outside the fixing device 103 via ducts (non-passing portion temperature rise countermeasure duct: air flow means) 128L, 128R. As a result, the air F flows toward both end portions of the fixing belt 105 in one end side and the other end side with respect to the widthwise direction (longitudinal direction) of the fixing belt 105. That is, the ducts 128L, 128R guide the air from the fans 127L, 127R toward the end portions of the fixing belt 105. By a cooling constitution using the above air blowing (air flow), an end portion temperature rise (non-passing portion temperature rise) is suppressed.

(2-2) Structure of Heating Unit

Figure 3:
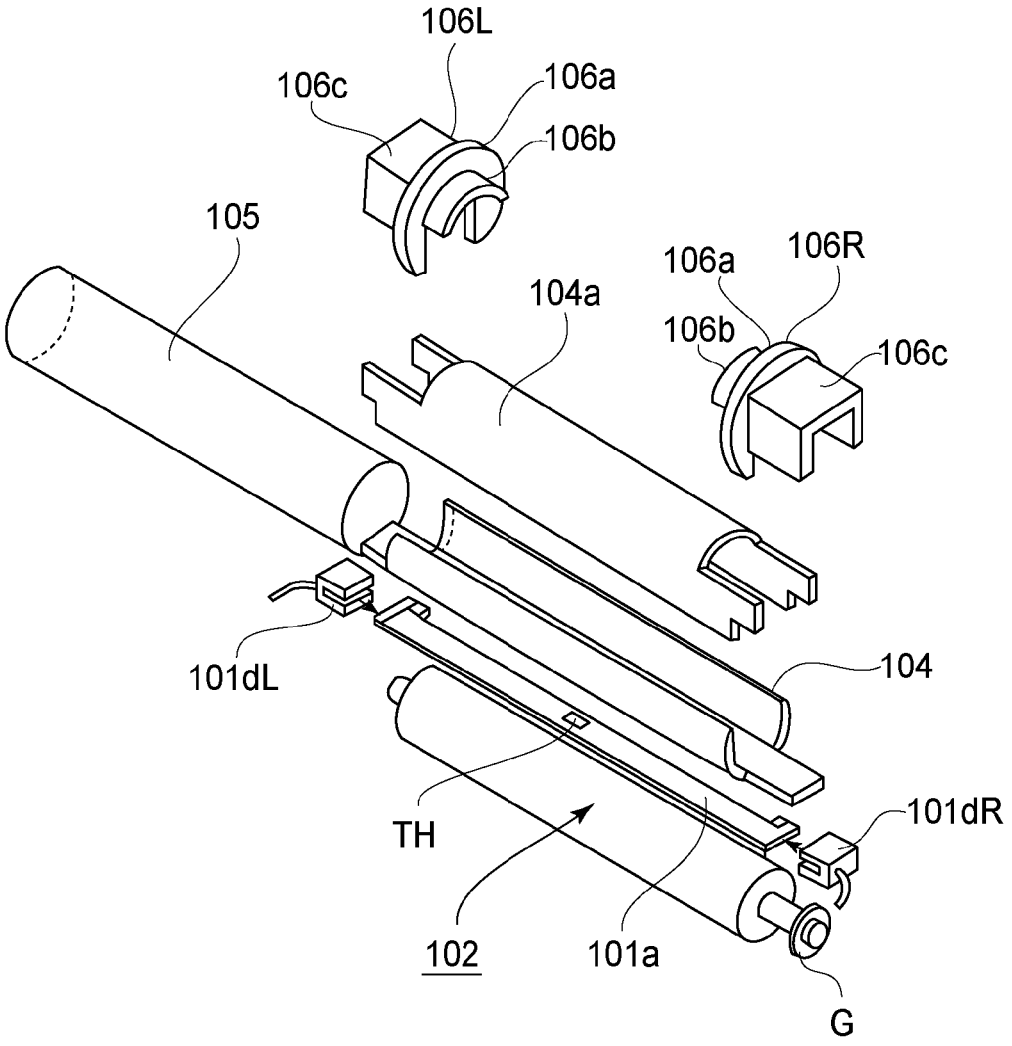
FIG. 3 is an exploded perspective view of a heating unit.

FIG. 3 is an exploded perspective view of the heating unit 101. Incidentally, also the pressing roller 102 is illustrated in FIG. 3.

The heating unit 101 is an assembled member including a heater holder 104, a planar heater 101*a*, an urging (pressing) stay 104*a*, the fixing belt 105 as a rotatable heating member (endless belt) to be rotated, flanges 106L, 106R positioned in one end side and the other end side of the fixing belt 105 with respect to the widthwise direction of the fixing belt 105, and the like.

The heater holder 104 is an elongated member having an almost semi-circular trough shape in cross section, and is formed of a heat-resistant resin material such as a liquid crystal polymer. The heater 101*a* is an elongated (thin) plate-like heat generating member having low thermal capacity such as the ceramic heater which abruptly increase in temperature by electric power (energy) supply, and is disposed along and held by the heater holder 104. The urging stay 104*a* is an elongated rigid member having a U-shape in cross section, and is formed of metal such as iron and is provided inside the heater holder 104. The fixing belt 105 is loosely engaged (fitted) externally with the assembled member of the heater holder 104, the heater 101*a* and the urging stay 104*a*.

The flanges 106L and 106R are symmetrical molded members formed of a heat-resistant resin material, and are mounted symmetrically in longitudinal end sides of the heater holder 104. Each of the flanges 106L and 106R includes, as shown in FIG. 3, a flange portion 106*a*, a shelf portion 106*b* and a portion-to-be-urged 106*c*.

The flange portion 106*a* is a member for limiting movement of the fixing belt 105 in a thrust direction by receiving an end surface of the fixing belt 105, and has an outer configuration larger than an outer configuration of the fixing belt 105. The shelf portion 106*b* is provided in an arcuate shape in an inner surface side of the flange portion 106*a* and holds the fixing belt end portion inner surface to keep the cylindrical shape of the fixing belt 105. The portion-to-be-urged 106*c* is provided in an outer surface side of the flange portion 106*a*, and an urging force T (FIG. 2) is applied thereto by an urging means (not shown).

(2-3) Structure of Fixing Belt

Figure 5:
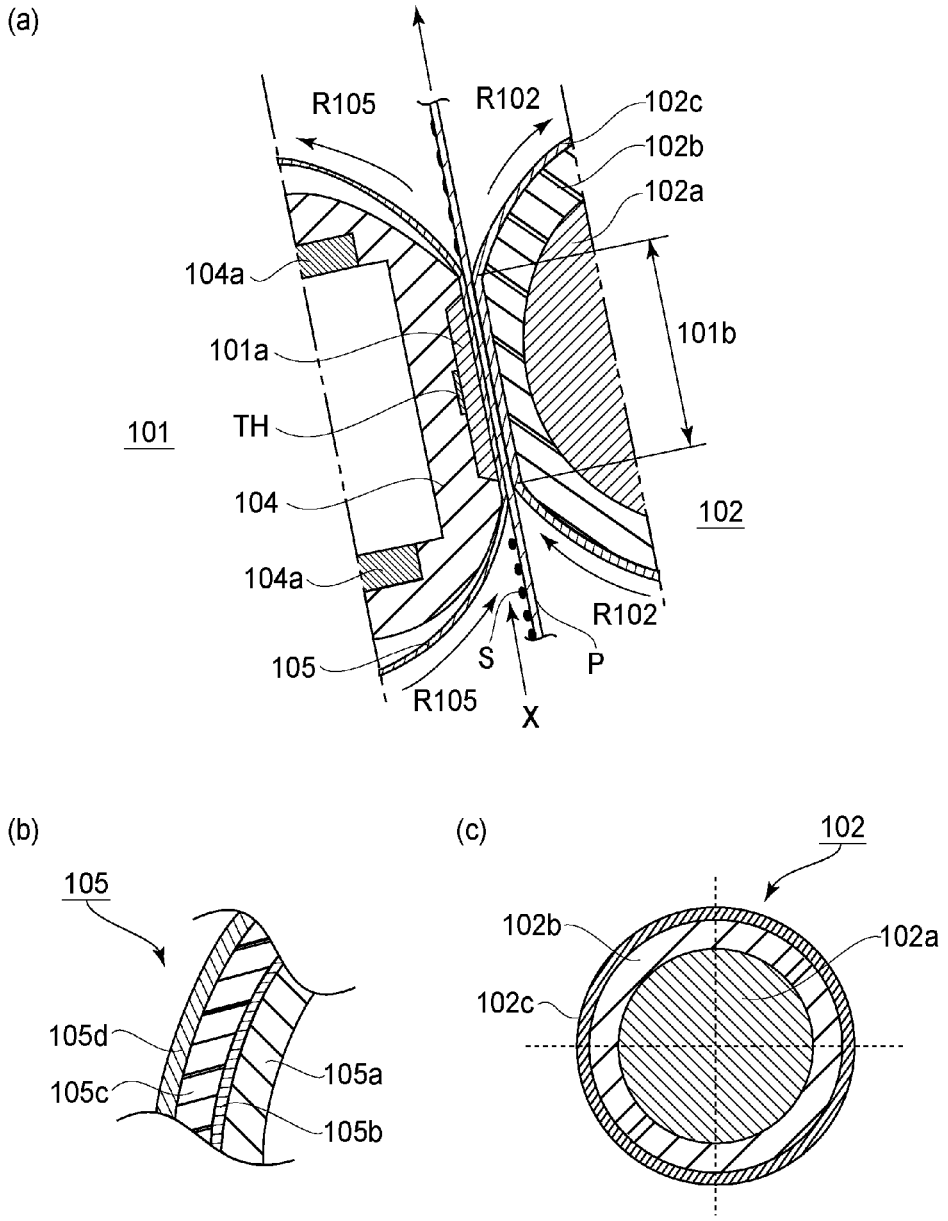
In FIG. 5, (a) is an enlarged view of a fixing nip, (b) is a schematic view showing a layer structure of a fixing belt, and (c) is a schematic view showing a layer structure of a pressing roller.

In FIG. 5, (a) is a partly enlarged view of the nip 101*b* shown in FIG. 1A, and (b) is a schematic view showing a layer structure of the fixing belt 105 in this embodiment. The fixing belt 105 is a composite-layer member in which an endless (cylindrical) base layer 105*a*, a primer layer 105*b*, an elastic layer 105*c* and a parting layer 105*d* are laminated in the listed order from an inside to an outside thereof. The fixing belt 105 is a thin member having a flexibility as a while and a low thermal capacity. In a free state, the fixing belt 105 exhibits an almost cylindrical shape (FIG. 3) by elasticity thereof.

The base layer 105*a* is a metal-made base layer of SUS (stainless steel) or the like and has a thickness of about 30 μm in order to resist a thermal stress and a mechanical stress. The primer layer 105*b* is formed on the base layer 105*a* in a thickness of about 5 μm by applying a primer onto the base layer 105*a*.

The elastic layer 105*c* is deformed when the toner image is press-contacted to the fixing belt 105, and thus performs the function of causing the parting layer 105*d* to be hermetically contacted to the toner image. As a material for the parting layer 105*d*, PFA resin excellent in parting property and heat-resistant property is used for ensuring a deposition-preventing performance of the toner and paper power (dust). The thickness of the parting layer 105*d* is about 20 μm from the viewpoint of ensuring a heat conduction property.

(2-4) Structure of Pressing Roller

In FIG. 5, (c) is a schematic view showing a layer structure of the pressing roller 102.

The pressing roller 102 is an elastic roller including a core metal 102*a* of aluminum or iron, an elastic layer 102*b* formed of a silicone rubber or the like, and a parting layer 102*c* for coating the elastic layer 102*b*. The parting layer 102*c* is formed of a fluorine-containing resin material such as PFA and is coated with a tube.

The casing 100 includes, as shown in FIGS. 1 and 2, an elongated metal plate-made inner frame constituted by a base plate 109, a stay 108, a one end side plate 107L and the other end side plate 107R. The casing 100 further includes an elongated heat-resistant resin material-made outer frame which is mounted outside the inner frame and which is constituted by a cover 110, a first upper cover 111, a front cover 112, a second upper cover 113, a one end side cover 117L and the other end side cover 117R. In FIG. 2, in order to avoid complicatedness, a part of components such as a second upper cover 113 and the like is omitted.

Between the one end side plate 107L and the other end side plate 107R of the inner frame, the pressing roller 102 is rotatably supported and disposed in one end side and the other end side of the core metal 102 via bearings (not shown) as holding members. The heating unit 101 is provided in parallel to the pressing roller 102 between the one end side plate 107L and the other end side plate 107R of the inner frame while opposing the pressing roller 102 in the heater 101*a* side.

Here, the flanges of 106L and 106R in one end side and the other end side of the heating unit 101 are mounted slidably (movably) relative to guide holes, directed toward the pressing roller 102, formed in the side plates 107L and 107R, respectively, in one end side and the other end side of the inner frame. Each of the flanges 106L and 106R in one end side and the other end side is urged by an urging means (not shown) in a direction toward the pressing roller 102 with a predetermined urging force T (FIG. 2).

By the above-described urging force T, a whole of the flanges 106L and 106R, the urging stay 104*a* and the heater holder 104 is moved toward the pressing roller 102. For that reason, the heater 101*a* is urged toward the pressing roller 102 via the fixing belt 105 with the predetermined urging force T, so that the nip 101*b* having a predetermined width with respect to the sheet feeding direction X is formed between the fixing belt 105 and the pressing roller 102.

(2-5) Fixing Sequence

An operation of a fixing sequence (fixing process) of the fixing device 103 is as follows.

The control circuit portion A (FIG. 4) rotationally drives the predetermined roller 102 at point control timing in a rotational direction R102 in FIG. 1B at a predetermined speed. The rotational drive of the pressing roller 102 is made by transmitting a driving force of a driving source (not shown) to a driving gear G (FIG. 3) provided integrally with the pressing roller 102.

By the rotational drive of the pressing roller 102, at the nip 101*b*, a rotational torque acts on the fixing belt 105 due to a frictional force between the fixing belt 105 and the pressing roller 102. As a result, the fixing belt 105 is rotated around the heater holder 104 and the urging stay 104*a* by the pressing roller 102 at a speed substantially corresponding to a speed of the pressing roller 102 while sliding at its inner surface on the heater holder 104 in close contact with the heater 101*a*. That is, in this embodiment, the pressing roller 102 also performs a function as a driving roller (rotatable driving member) for rotationally driving the fixing belt 105.

Further, the control circuit portion A starts electric power supply (energization) from a power source portion (not shown) to the heater 101*a*. The energization to the heater 101*a* is made via unergization connectors 101*d*L, 101*d*R (FIG. 3) mounted in one end side and the other end side of the heater 101*a*. By this energization, the heater 101*a* quickly increases in temperature over an entire effective length region. The temperature rise by the heating is detected by a thermistor TH as a temperature detecting means provided on a back surface side (opposite from the nip 101*b* side) of the heater 101*a*.

The control circuit portion A controls, on the basis of a heater temperature detected by the thermistor TH, electric power to be supplied to the heater 101*a* so that the heater temperature is increased up to and kept at a predetermined target set temperature. The target set temperature in this embodiment is about 170° C.

In the state of the fixing device described above, the sheet P on which unfixed toner images S are carried is fed from the secondary transfer portion side of the image forming portion to the fixing device 103 side. Then, the sheet P is introduced into a nip entrance (sheet entrance), 101*c* by being guided by a guiding member 110*a* for the introducing opening 400, so that the sheet P is nipped and fed through the nip 101*b*. To the sheet P, heat of the heater 101*a* is applied via the fixing belt 105 heated in a process in which the sheet P is nipped and fed through the nip 101*b*. The unfixed toner images S are melted by the heat of the heater 101*a* and are fixed on the sheet P by pressure applied to the nip 101*b*. The sheet P coming out of the nip 101*b* is relayed by a fixing discharge roller pair 118 and is sent to an outside of the fixing device 103 through the discharging opening 500.

(3) Parting Agent Incorporated in Toner

Next, a parting agent incorporated (contained) in the toner S, i.e., a wax in this embodiment will be described.

There is a liability that a phenomenon which is called offset such that the toner S is transferred onto the fixing belt 105 during fixing is caused. Such an offset phenomenon leads to a factor which causes a problem such as an image defect.

Therefore, in this embodiment, the wax is incorporated into the toner S. That is, during the fixing, the wax bleeds from the toner S. As a result, the wax melted by heating is present at an interface between the fixing belt 105 and the toner image on the sheet P, so that it becomes possible to prevent the offset phenomenon (parting action).

Incidentally, also a compound containing a molecular structure of the wax is referred herein to as the wax. For example, such a wax is obtained by reacting a resin molecule of the toner with a wax molecular structure. Further, as a parting agent, other than the wax, it is also possible to use another substance, such as a silicone oil, having a parting action.

In this embodiment, paraffin wax is used and a melting point Tm of the wax is about 75° C. In the case where the heater temperature at the nip 101*b* is kept at the target set temperature of 170° C., the melting point Tm is set so that the wax in the toner S is instantaneously melted to bleed out to an interface between the toner image and the fixing belt 105.

The wax bleeding out from the toner image is positioned at the interface between the toner image and the fixing belt 105, but a part thereof is heated on the fixing belt 105 after being transferred the fixing belt 105. This is because the surface of the fixing belt 105 from which heat is taken by the sheet P at the nip 101*b* and which is lowered in temperature is heated again by the heater 101*a*.

At this time, there is a time difference of heat from after the inner surface of the fixing belt 105 is heated until the heat conducts to the outer surface of the fixing belt 105. For that reason, the surface temperature of the fixing belt 105 is higher in the fixing nip entrance 101*c* side than in the fixing nip exit 101*d* side. Such a phenomenon that the surface temperature of the fixing belt 105 is higher at the fixing nip entrance 101*c* that at the fixing nip exit 101*d* is also true for the dust 103 through which the sheet P is passed.

This is because the fixing belt 105 rotates, and the surface temperature of the fixing belt 105 always lowers immediately after the sheet P is passed through the fixing device 103. In order to increase the temperature of the toner image on the sheet P fed to the fixing device 103 to not less than a temperature required for fixing the toner image on the sheet P, the temperature of the fixing nip entrance 101*c* becomes high.

Figure 12:
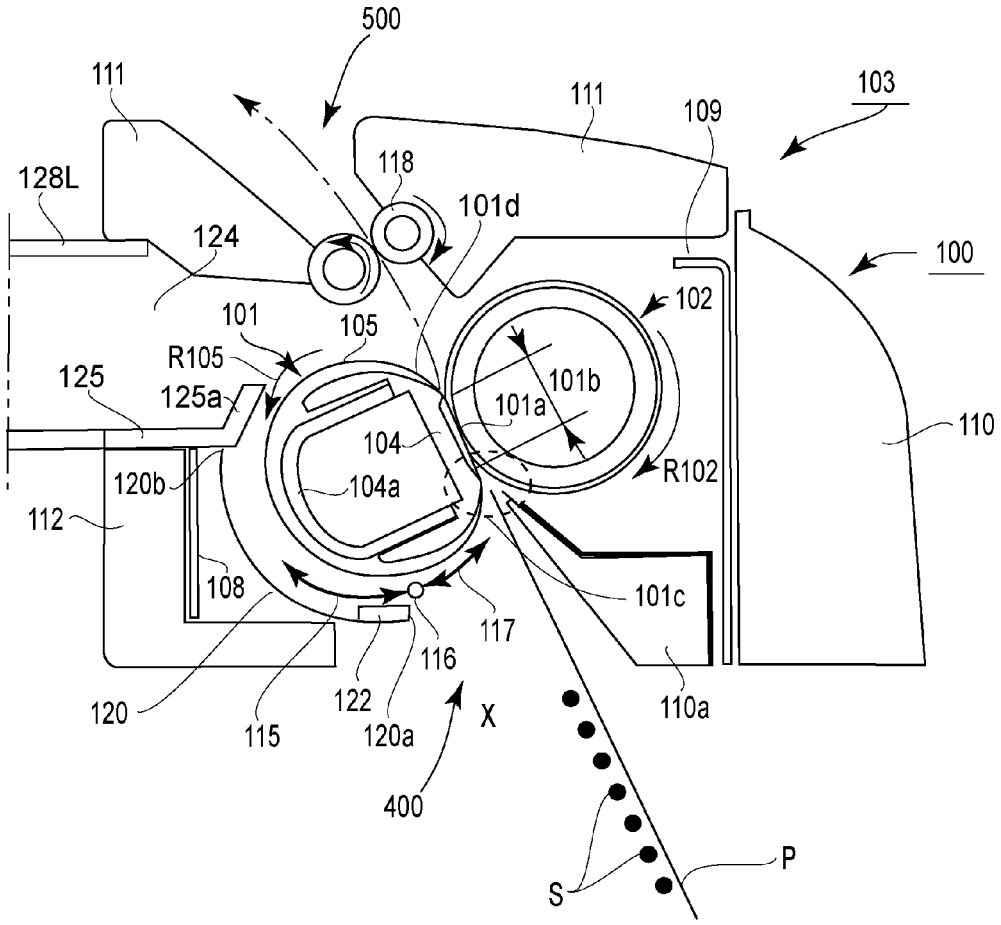
FIG. 12 is a schematic view showing a high temperature region of a fixing belt.

A part of the wax such as a low-molecular-weight component in the wax is vaporized (volatilized) in regions 115, 117 shown in FIG. 12. The regions 115, 117 corresponds to an almost half circumferential surface region of the fixing belt 105 ranging from the nip entrance 101*c* in an upstream side of a fixing belt rotational direction. Although the wax is constituted by a long-chain molecular component, a length of the component is not uniform and has a certain distribution. The wax contains a low-molecular-weight component having a short chain and a low boiling point and a high-molecular-weight component having a long chain and a high boiling point. When the wax is vaporized in the regions 115, 117, it would be considered that the low-molecular-weight component as a part of the wax is vaporized.

The vaporized wax component is condensed by being cooled in the air, so that fine particles (dust) of several nm to several hundred nm in particle diameter can exist immediately after the condensation. However, most of the condensed wax component forms the fine particles of several nm to several ten nm in particle diameter.

This can be confirmed by measuring the dust.

Measurement of the dust was made using a high-speed response type particle sizer ("FMPS", mfd. by TSI Inc.) was used. The particle sheet (FMPS) is capable of measuring a particle size distribution, a number density (concentration) (particles/$cm^3$) and a weight density (concentration) (μg/$m^3$). In this embodiment, the fine particles of 5.6 nm or more and 560 nm or less in particle size measurable by the particle sizer (FMPS) are regarded as the dust.

Figure 13:
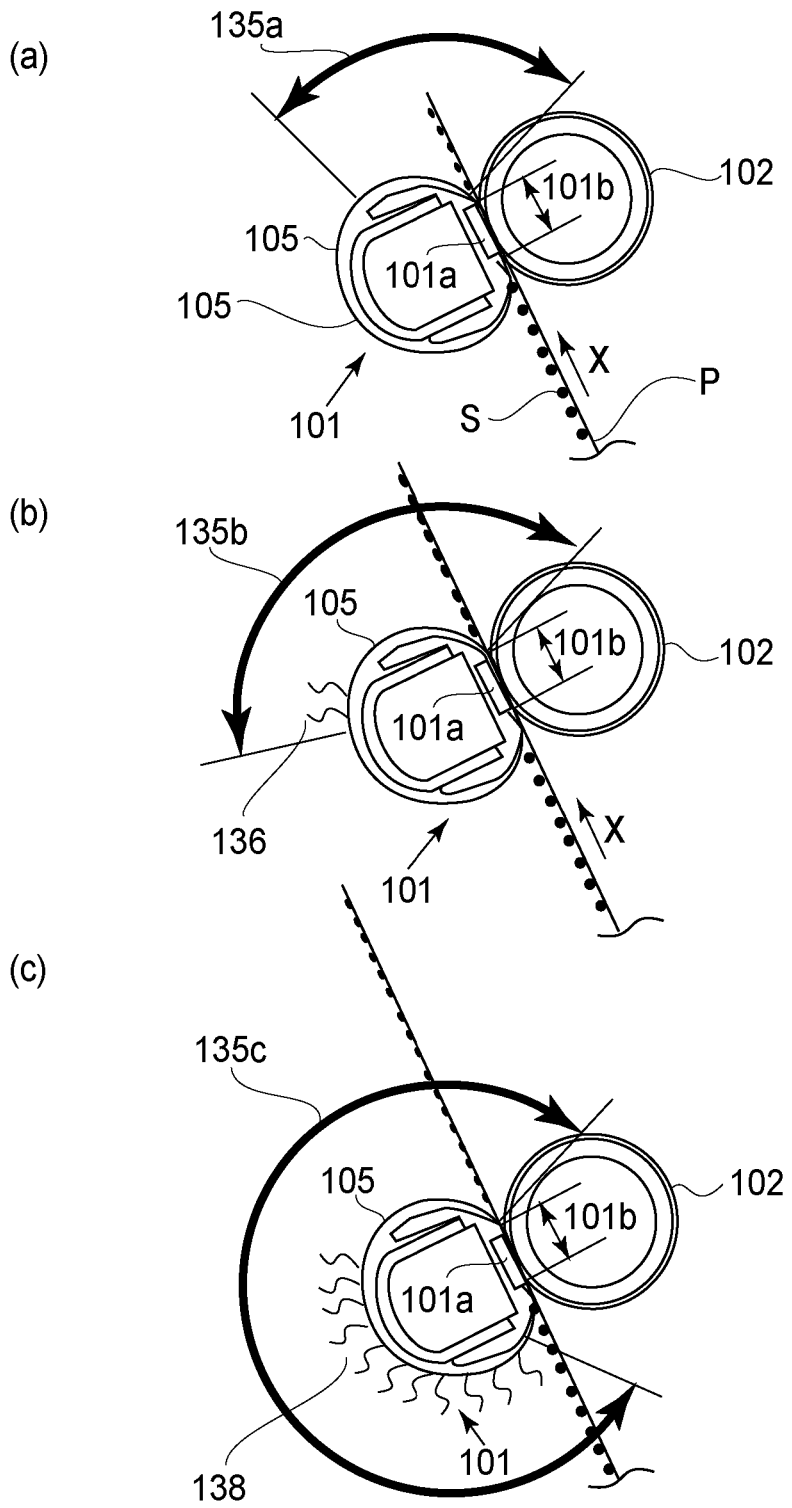
In FIG. 13, (a) to (c) are schematic views each showing a wax deposition region on the fixing belt and a dust generation region.

(4) Generated Particles (Dust) Resulting from Parting Agent with Fixing Process (4-1) Dust Generation Position In FIG. 13, each of (a) to (c) shows a process in which the wax deposited on the fixing belt 105 is vaporized. In FIG. 13, the heating type using the ceramic heater 101*a* is shown, but the process is similarly applied when a fixing device 103 (FIG. 8) including a heating source inside the fixing belt 105 as in the heating type using, e.g., the halogen heater is used.

In a state of (a) of FIG. 13, only a leading end portion of the toner images passes through the nip 101*b*, and therefore a wax deposition region is a region 135*a* (fixing belt circumferential region corresponding to a toner image length region at a portion of the sheet coming out of the nip entrance) shown in the figure. In this stage, the wax is not vaporized.

In a state of (b) of FIG. 13, by the advance of the sheet feeding, the wax deposition region extends to a range of a region 135*b* in the figure. At a portion 136 where the temperature of the fixing belt 105 reached a vaporization temperature of the wax, dust generates simultaneously with start of the vaporization of the wax.

In a state of (c) of FIG. 13, by further advance of the sheet feeding, the wax deposition region extends to a range of a region 135*c*, so that the wax is vaporized in a broader range 138 and thus the dust generates.

This dust is the wax component and therefore has an adhesive property, so that there is a liability that the dust is deposited in positions inside the image forming apparatus 1 to cause a problem. For example, when the dust is fixed and deposited on the fixing discharge roller pair 118 (FIG. 4) and the discharge roller pair 114 to generate contamination, there is a liability that the contamination is transferred onto the sheet P to adversely affect the image. Further, there is a liability that the dust is deposited on a filter 600 (FIG. 4) provided in an exhausting (heat exhausting) mechanism for exhausting ambient air at a periphery of the fixing device 103, thus causing clogging.

(4-2) Property of Dust

According to study by the present inventor, it has turned out that the particle size of the dust generated from the fixing belt 105 depends on a spatial temperature in the neighborhood of the fixing belt 105.

Figure 6:
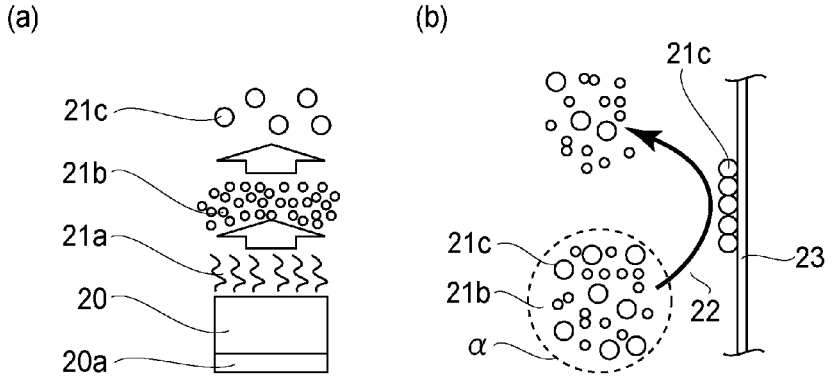
In FIG. 6, (a) is a schematic view for illustrating a coalescence phenomenon of a dust, and (b) is a schematic view for illustrating a deposition phenomenon of the dust.

As shown in (a) of FIG. 6, when a high-boiling-point substance 20 of 150-200° C. in boiling state is placed on a heating source 20*a* and is heated to about 200° C., a volatile matter 21*a* of the high-boiling-point substance 20 is generated. The volatile matter 21*a* is decreased in temperature to a boiling point temperature or less immediately after the volatile matter 21*a* contacts the air at a normal temperature, and therefore the volatile matter 21*a* agglomerates in the air, thus being changed into fine particles (dust) 21*b* of several nm to several ten nm in particle size. This phenomenon is the same as a phenomenon that water vapor is changed into minute water droplets to generate fog when the temperature of the water vapor is below a dew-point temperature.

In this case, the agglomeration and particle formation of the gas in the air is more impaired with a higher temperature in the air. This is because vapor pressure increase with the higher temperature in the air and thus gas molecules are easily kept in a gaseous state. As a result, with the higher temperature in the air, the number of generation of the dust becomes smaller. Further, excessive gas existing in the air gathers around the dust and thus agglomerates on the dust. This is because compared with energy required for newly generating the dust by agglomeration of the gas molecules, energy required for causing the gas molecules to agglomerate around the dust is lower.

It has been known that the particles of dust 21*b* generated in the above-described process move in the air by the Brownian movement and therefore mutually collide and coalesce to grow into the particles of the dust 21*c* having a larger particle size. This growth is accelerated when the dust more actively moves, in other words, when the temperature in the air is higher temperature state. As a result, with respect to the particle size of the dust and the number of particles of the dust, with a higher spatial temperature in the neighborhood of the fixing belt 105, the particle size becomes larger and the number of particles becomes smaller.

Further, the growth of the particle size gradually slows down and stops when the dust has a certain particle size or more. This is presumably because when the dust is increased in particle size by the coalescence, the movement of the dust in the air by the Brownian movement becomes inactive.

Further, as a property of the dust resulting from the parting agent (wax), such a property that the dust deposits on an ambient solid matter has been known. With reference to (b) of FIG. 6, the case where the air a containing the minute dust 21*b* and the larger dust 21*c* moves toward a wall 23 along airflow 22 will be considered. At this time, the larger dust 21*c* than the minute dust 21*b* is liable to be deposited on the wall 23 and is less liable to be diffused.

This is presumably because the dust 21*c* has a large force of inertia and vigorously collides against the wall 23. This phenomenon is similarly generated even in the case where the airflow speed is not more than 0.2 m/s which is below a measurement limit of an anemometer, i.e., even in the case where the airflow speed is very slow. Therefore, it is understood that when the dust 21*c* is increased in particle size more and more, particularly, the fine particles of about several hundred nm are readily left in the fixing device (most of the fine particles is deposited on the belt) and thus diffusion toward the outside of the fixing device can be suppressed.

In this way, the dust has two properties including such a property that the dust is increased in particle size with the increase in the temperature in the air and such a property that the dust is liable to be deposited on a peripheral object (member) when the dust is increased in particle size. Accordingly, it is understood that when the dust is increased in particle size by increasing the temperature in the air, it is possible to suppress the diffusion of the dust toward the outside of the fixing device in a state of the fine particles (particle size immediately after the condensation). Incidentally, eased of the coalescence of the dust depends on components, temperature and density of the dust. For example, when an easily adhesive component is soften at high temperatures and when collision probability between dust particles is increased at a high density, the dust particles are liable to coalesce.

(5) Dust Diffusion Suppressing Mechanism

When a dust diffusion suppressing measure in the image forming apparatus 1 is studied on the basis of the above-described properties of the dust, it is understood that the temperature in the air in the neighborhood of the dust generating position (portion) 138 indicated by wavy lines in (c) of FIG. 13 may only be required to be increased.

When the dust generating position is described on the basis of FIG. 12, the dust generating position is a region obtained by adding, to the region 115 on the fixing belt 105, a region ranging from the region 115 to the nip entrance 101*c* along a rotational direction R105 of the fixing belt 105.

The dust diffusion suppressing mechanism is a mechanism for suppressing diffusion of the dust by increasing the temperature of the fixing belt 105 in the air in the neighborhood of the dust generating position 138 described above. As shown in FIG. 1B, the diffusion suppressing mechanism includes a diffusion suppressing member 120 functioning as a suppressing portion in the neighborhood of the introducing opening 400. The diffusion suppressing member 120 is a member for covering an outside surface (outside surface region substantially corresponding to the dust gaping position 138) of the fixing belt 105 (hereinafter, this member is referred to as a cover member).

The cover member 120 is positioned between the casing 100 and the fixing belt 105. At an end portion (one end portion) 120*a* of the cover member 120 in the nip entrance 101*c* side, a projected portion (rib) 122 which extends toward the fixing belt 105 and which extends in the widthwise direction of the cover member 120 is provided. By contact between the projected portion 122 and the flange portion 106*a* (FIG. 3), it is possible to ensure a predetermined gap T between the projected portion 122 and the fixing belt 105.

The end portion 120*a* of the cover member 120 extends to the neighborhood of a terminal position 116 of a region 117 where the leading end of the sheet P is contactable to the fixing belt 105 as shown in FIG. 12. The region 117 means the region where the leading end of the sheet P introduced into the nip entrance 101*c* is contactable to the fixing belt 105 when the leading end of the sheet P is curled or bent (folded).

Further, in an end portion (the other end portion) 120*b* side, opposite from the end portion 120*a* in the nip entrance 101*c* side, of the cover member 120, as described later, the end portion 120*b* extends to the ducts 128L, 128R or to a position where the end portion 120*b* contacts a shielding member 125.

A width W1 of the cover member 120 with respect to the longitudinal direction (widthwise direction) is, as shown in FIG. 8 which is a perspective view of a principal part of the fixing device 103, set so as to be wider than a width W2 of the sheet P in a passing region of a toner image 121. When a maximum-width sheet usable in the image forming apparatus is used, the width W2 corresponds to a width (maximum image width) in which the image is formable on the maximum-width sheet. As a result, the cover member 120 and the projected portion 122 have such a positional relationship with the sheet P such that they extend to positions outside the region where the fixing belt 105 is contactable to the toner image 121. This is because the dust generates in the toner image passing region of the fixing belt 105.

In this way, the cover member 120 extends in the neighborhood of the surface of the fixing belt 105 and extends from the neighborhood of the sheet entrance of the nip N to the ducts 128L, 128R or from the neighborhood of the sheet entrance of the nip N to the shielding member 125. More specifically, the cover member 120 is disposed from the position 116, which is in the neighborhood of the surface of the fixing belt 105 and where the leading end of the sheet P introduced into the nip 101*b* and the fixing belt 105 are contactable to each other, and in the region 115 where the wax is vaporized. The width of the cover member 120 and the projected portion 122 is larger than a width of an image formable region of a maximum width sheet usable in the fixing device.

In such a constitution, the cover member 120 performs a function of increasing the temperature in the neighborhood of the fixing belt 105 by covering most (region 115 in FIG. 12) of the dust generating portion 138 in (c) of FIG. 13.

The cover member 120 increases the particle size of the dust by the temperature increase and thus suppresses the dust diffusion into the image forming apparatus 1. The dust increased in particle size moves upward by upward airflow (heat convection) generated at the periphery of the fixing belt 105 and deposits on the fixing belt 105 and the inside of the casing 100. The dust deposited on the fixing belt 105 is transferred onto the sheet P, but is small in dust size and therefore has no influence on the image.

(5-1) Arrangement (Gap T with Fixing Belt 105) of Cover Member 120

(5-1-1) Ambient Airflow of Fixing Belt 105

Before arrangement of the cover member 120 is described, a path along which the dust generated in the neighborhood of the induction opening 400 (nip entrance 101*c*) diffuses into the fixing device will be described on the basis of a verification result of a hot airflow simulation shown in FIG. 9.

In this verification with respect to the heat and the airflow, it is assumed that the fixing belt 105 at a surface temperature of 170° C. is rotated in the counterclockwise direction R105 at a speed V, the pressing roller 102 is rotated in the clockwise direction R102 at the speed V, and the sheet P is moved upward in the figure at the speed V.

For that reason, in this verification, ascending airflow (CD1) due to natural convection generated at the periphery of the fixing belt 105, an airflow (RD1) at the belt surface generated with surface movement of the fixing belt 105, and an airflow 26*a* generated the sheet P with movement of the sheet P are taken into consideration.

Figure 9:
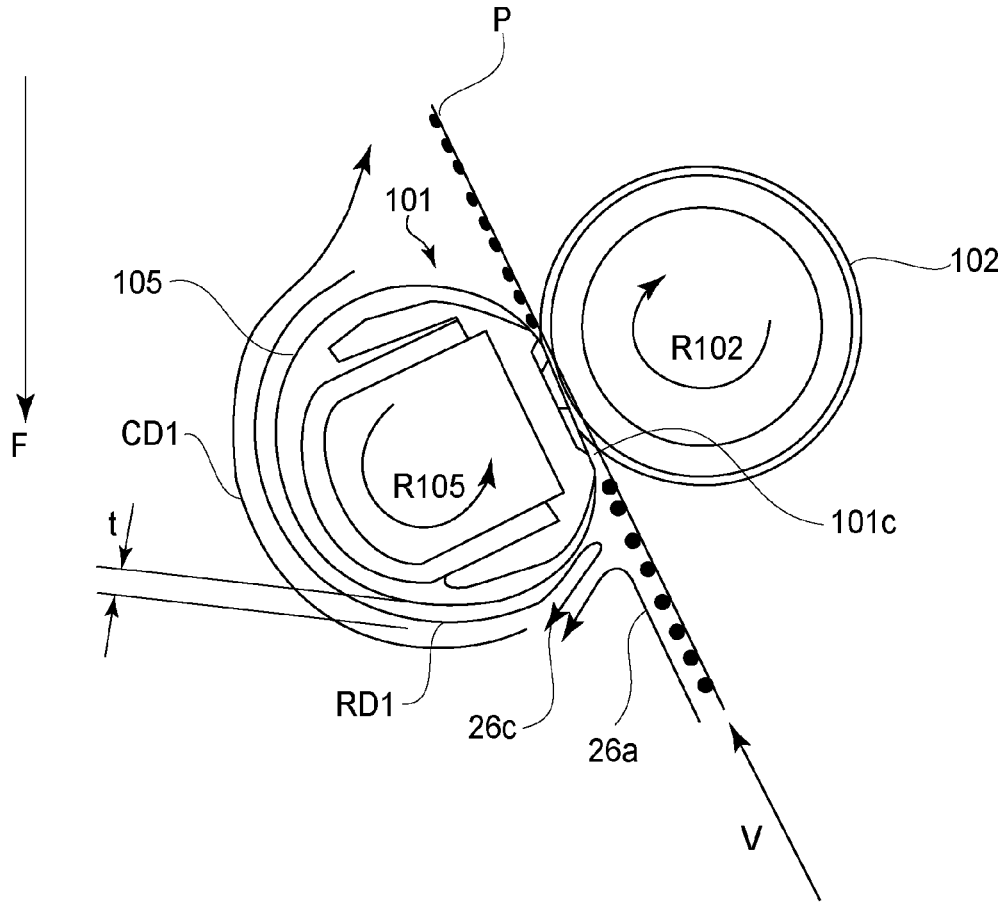
FIG. 9 is a schematic view showing air stream in a casing of the fixing device.

As shown in FIG. 9, it was confirmed that an airflow 26*c* which appears to lose a place to go at the nip entrance 101*c* and to be issued from the nip entrance 101*c* are present.

It would be considered that the airflow 26*c* is the issued air which loses the place to go as a result of collision at the nip entrance 101*c* between the airflow RD1 and the airflow 26*a* which is generated at the sheet surface with movement of the sheet surface.

Further, the airflow 26*c* merges with the airflow RD1 to form the airflow CD1 which is adjacent to the airflow RD1 and which flows in an opposite direction to the direction of the airflow RD1, i.e., the airflow which moves upward along the surface of the fixing belt 105. Incidentally, the airflow 26*c* was, as shown in FIG. 9, generated so as to move along the surface of the fixing belt 105, but this is presumed to be a result that the airflow is drawn by the natural convection moving upward in the neighborhood of the surface of the fixing belt 105.

(5-1-2) Action and Gap T of Cover Member 120

As described above, the cover member 120 has the function of increasing the temperature in the air at the periphery of the dust generating position 138 ((c) of FIG. 13). In order to ensure this temperature increasing action (function). The airflow 26*a* resulting from the airflow 26*a* at the surface of the sheet low in temperature and the airflow CD1 have to be prevented from entering between the cover member 120 and the fixing belt 105. For that reason, a predetermined gap T is provided between the cover member 120 and the fixing belt 105.

This gap T (mm) is made 0.5 mm or more and 3.5 mm or less ($0.5 \leq T \leq 3.5$) so that it is possible to ensure such an action that the airflow 26*c* and the airflow CD1 are moved away from the fixing belt 105.

By setting the gap T at 3.5 mm or less, as described later, the dust density can be lowered to a value of less than 70% at a point B (FIG. 7) in the neighborhood of the fixing device. Incidentally, the reason why a lower limit value is 0.5 mm is that when the cover member is caused to further approach the surface of the fixing belt 105, there is a liability that the cover member contacts the fixing belt 105.

In this embodiment, the cover member 120 is provided with the projected portion 122, but a similar effect can also be obtained by controlling the gap T between the fixing belt 105 and the projected portion 122. As an advantage of the presence of the projected portion 122, it is possible to cite that the gap T is easily controlled by no necessity that the entirety of the cover member 120 is brought near to the fixing belt 105.

At the position where the cover member 120 is disposed, particularly as the cover member 120 approaches the surface of the fixing belt 105, the temperature becomes high. For that reason, the cover member 120 deforms by thermal expansion, so that it becomes difficult to control the gap T in all the regions of the cover member 120. When a constitution in which only the projected portion 122 which is a part of the cover member 120 is brought near to the fixing belt 105 is employed, compared with the case where there is no projected portion 122, it is possible to suppress the deformation due to the thermal expansion. In this embodiment, the gap T is 1 mm. By the presence of the projected portion 122 closer to the fixing belt 105, the action of spacing the airflow (CF) and the upward airflow (CD) from the fixing roller 1 is enhanced.

(5-1-3) Effect of Cover Member 120

Figure 7:
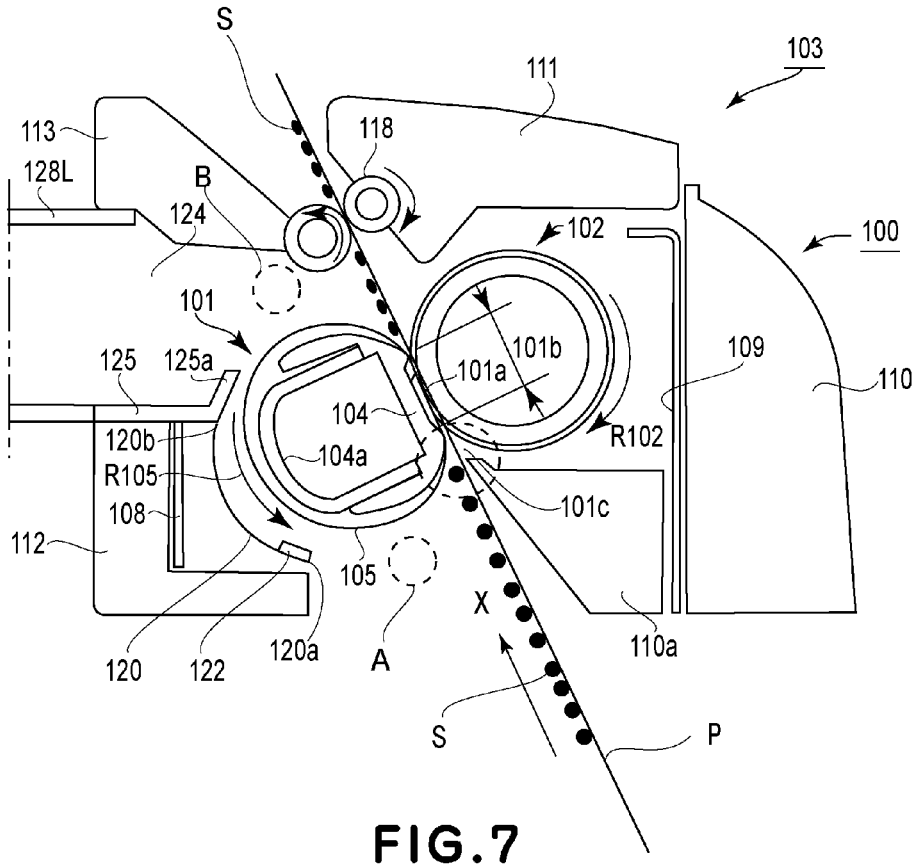
FIG. 7 is a schematic sectional view of the fixing device for illustrating a dust generation portion of the dust.

By disposing the cover member 120 as described above, the dust density measured at the point B shown in FIG. 7 can be suppressed to 70% or less compared with the case where there is no cover member 120. There is a measurement error of 30%, and therefore as such an index that the rib 122 can be regarded as being effective, "70% or less" is set. The point B is set at a position of about 20 mm away from the fixing belt 105 in a path along which the dust generated from the fixing belt 105 is discharged by the ascending airflow due to the heat convection. When the dust density at the point B is 70% or less, it is possible to reduce a degree of contamination of the inside of the image forming apparatus with the wax in the outside of the fixing device 103.

The dust density can be measured by the above-described high-speed response type particle sizer (FMPS). Further, the measurement is made under the following condition. Specifically, under a condition such that A4-sized plain paper is fed by long edge feeding on the basis of a standard original of 5% in print ratio, fixing is continuously effected for 11 minutes. Further, for 1 minute (from after 10 minutes to 11 minutes) before end of the fixing, the dust density is measured. A measured value was obtained by averaging the dust densities in 1 minute.

Incidentally, the measuring position may also be a position of the discharging roller pair 118 or a filter 600 or the like shown in FIG. 4, where the contamination with the wax generates. This is because the dust density varies depending on the measuring position, but an effect of preventing the contamination with the wax can be estimated by a lowering rate of the dust density.

Further, in this embodiment, the dust density refers to the number density (particles/$cm^3$) of the fine particles having the particle size (diameter) in a predetermined range, i.e., the fine particles of 5.6 nm or more and 560 nm or less in particle size. That is, the number density measured at the point B may desirably be less than 70% of the number density in the constitution in which the diffusion suppressing member 120 which is the suppressing portion as employed in this embodiment is not provided. Incidentally, as the dust density, in place of the number density (particles/$cm^3$), the weight density ($\mu g/m^3$) may also be employed.

In this embodiment, with respect to the gap T (Figure B) between the cover member 120 and the surface of the fixing belt 105, the value thereof was narrowed stepwisely in the order of 4.0 mm, 3.5 mm, 2.5 mm, 2.0 mm and 1.5 mm. At this time, a verification that the dust density at the point B was lowered with a narrowing gap T was made. As a result, it was confirmed that when the gap T is 3.5 mm or less, the above-described condition (the dust density at the point B: 70% or less) is satisfied.

(5-1-4) Another Method of Determining Gap T

Figure 10:
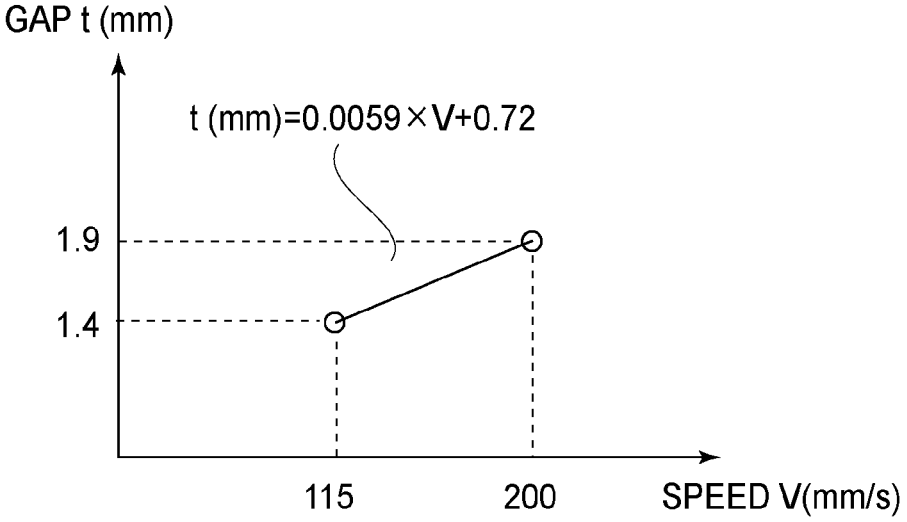
FIG. 10 is a graph showing a relationship between a gap and a peripheral speed.
Figure 11:
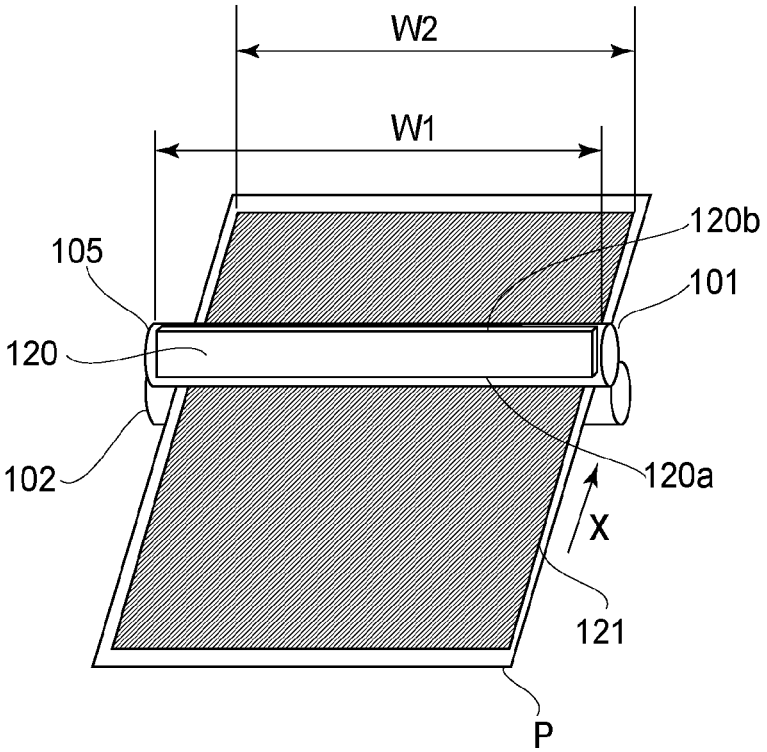
FIG. 11 is a schematic view showing a positional relationship between a toner image passing region and a direction-suppressing member.

The gap G may also be determined by a peripheral speed V (mm/s) of the fixing belt 105. In FIG. 9, t is a width of the airflow RD1. That is, t represents a distance from a boundary between the airflows RD1 and CD1 to the fixing belt 105. This width t was subjected to verification (simulation). FIG. 10 shows a result of the verification.

As shown in FIG. 10, when the surface peripheral speed V of the fixing belt 105 is 115 mm/s, t is 1.4 mm, and when the peripheral speed V is 200 m/s, t is 1.9 mm. A flow rate of the airflow RD1 along the fixing belt 105 increases with a larger surface speed (i.e., peripheral speed V) of the fixing belt 105. As a result of the increase in flow rate of the airflow RD1 by the increase in peripheral speed V, it is presumed that the value of t becomes large. When the two points shown in FIG. 10 are linearly-interpolated, the following equation is obtained.

$$t = 0.0059 \times V + 0.72$$

When setting is made so that the gap T exceeds the width t, the diffusion suppressing member 120 as the suppressing portion can block the airflow CD1 with reliability. As a result, a lowering in ambient temperature of the fixing belt 105 is prevented, so that the dust can be reduced. A lower limit value of t is 0.5 mm. When the above equation and this lower limit value are combined, the range of T can be expressed by the following formula.

$$0.5 \leq T \leq 0.0059 \times V + 0.72$$

This formula is particularly effective when the peripheral speed V of the fixing belt 105 in a range of: 115 mm/s≤V≤200 mm/s. However, a relationship between the peripheral speed V and the width t is estimated as being close to a linear relationship, and therefore the above formula is also effective even in the case where the peripheral speed V is not in the above range.

(5-2) Cooling Mechanism

The fans 127L, 127R are driven when an operation in a continuous print mode using a small-sized sheet is executed or when a temperature sensor (not shown) for detecting the end portion temperature rise of the fixing belt 105 detects a temperature not less than a predetermined temperature. By this drive of the fans, the air F flows through the opening 124 via the ducts 128L, 128R. As a result, the air F flows toward both end portions of the fixing belt 105 in one end side and the other end side of the fixing belt 105 with respect to the widthwise direction (longitudinal direction). By this air blowing cooling mechanism, the end portion temperature rise (non-passing portion temperature rise) is suppressed.

Here, the drive control of the fans 127L, 127R can also be effected in the following manner. For example, control for driving the fans 127L, 127R when the print number reaches a certain number after start of the printing may also be effected. Further, control for driving the fans 127L, 127R when a certain time elapses from the start of the printing may also be employed. At that time, a driving amount of the fans 127L, 127R is determined in advance depending on a disposition environmental temperature of the image forming apparatus 1, a size of the sheet P and the printing time.

As described above, when the air F cools the widthwise end portions of the fixing belt 105 by the fans 127L, 127R, there is a liability that a pair of the air F enters a space portion between the outside of the cover member 120 and the inside of the casing 100 and flows into the nip entrance 101*c* side. Then, the flow-in of the air diffuses the dust stagnating at the nip entrance 101*c* and the neighborhood of the nip entrance 101*c* is cooled, so that there is a liability that gas molecules which are not formed into the dust agglomerate to generate a large amount of the dust.

Therefore, in this embodiment, as shown in FIG. 1B, the cover member 120 is extended to the ducts 128L, 128R. As a result, in the duct 128L, 128R sides, the space portion between the outside of the cover member 120 and the inside of the casing 100 is closed, so that the movement of the air F into the space portion is suppressed and thus it is possible to suppress the diffusion and the generation of the dust.

The following device constitution may also be employed. The shielding member 125 is provided so as to prevent flowing of the air F toward the nip entrance 101*c* side (sheet introducing side of the nip) by being disposed in the nip entrance 101*c* side at the opening 124 of the casing 100 to block between the fixing belt 105 and the casing 100. The shielding member 125 has a bent portion 125*b* and is provided with an extended portion 125*a* extending from the bent portion 125*b* in the nip entrance 101*c* direction (sheet exit direction of the nip 102*b*) along the fixing belt 105.

By the above-described constitution of the shielding member 125, it is possible to prevent the air F from entering the neighborhood of the nip entrance 101*c* and thus to suppress the diffusion and generation of the dust.

Between the shielding member 125 and the fixing belt 105, a predetermined gap L (mm) is provided and can be expressed by the following formula similarly as in the range of the above-described gap T.

$$5 \leq L \leq 0.0059 \times V + 0.72$$

The reason why the gap L is provided is that when the shielding member 125 is brought near to the surface of the fixing belt 105, there is a liability that the shielding member 125 contacts the fixing belt 105. For that reason, a lower limit value is set at 0.5 mm. In addition, the gap L is provided for preventing that the dust generated in the neighborhood of the nip entrance 101*c* (in the neighborhood of the sheet entrance of the nip N) is raised by the upward airflow CD1 and is diffused by the fan 127.

Incidentally, the effect of the present invention is not impaired even when the gap L is not limited to the above range. At that time, it is possible to confirm the effect of the present invention when the air speed in the nip entrance 101*c* is measured before and after the shielding member 125 is provided, and decreases by 20% or more.

<Other Embodiments>

1) The first rotatable member in the fixing device is not limited to the belt member in Embodiment described above. The first rotatable member may also be a roller member heated by some heating means. The second rotatable member is not limited to the roller member, but may also be the belt member.

2) The fixing device may also include, in addition to the device (apparatus) for fixing the unfixed toner image as a fixed image, the case of an image modifying device (also called the fixing device) for improving glossiness by heating and pressing again the toner image which is temporarily fixed or once heat-fixed on the sheet.

3) The fixing device is not limited to the fixing device fixedly provided in the image forming apparatus, but may also be in the form in which the fixing device is assembled into a unit which is detachably mountable to the apparatus main assembly of the image forming apparatus so as to be exchangeable or connectable. Further, independently of the image forming apparatus, the fixing device may also be provided in the device form usable alone.

4) In the image forming apparatus, the image forming portion (image forming mechanism portion) for forming the toner image on the sheet P is not limited to the electrophotographic image forming portion of the transfer type in Embodiment described above. The image forming portion may also be an electrostatic recording image forming portion and a magnetic recording image forming portion which are of the transfer type using an electrostatic recording dielectric member and a magnetic recording (magnetic) member, respectively, as an image bearing member.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-205610 filed on Oct. 6, 2014, which is hereby incorporated by reference herein in its entirety.

What is claimed is:

1. A fixing device comprising:

first and second rotatable members configured to fix, at a nip therebetween, a toner image formed on a sheet by using a toner containing a parting agent;

a casing provided with a sheet introducing opening and a sheet discharging opening and configured to include said first and second rotatable members;

a fan;

a duct that extends into an inner side of said casing from an outer side of said casing and is configured to guide air from said fan toward one longitudinal end portion of said first rotatable member; and a cover member provided in the inner side of said casing and configured to cover an outer surface of said first rotatable member, wherein said cover member has one end opposed to said sheet introducing opening and the other end contacted with said duct in a rotational direction of said first rotatable member.

2. A fixing device according to claim 1, wherein when a gap between said cover member and said first rotatable member is T (mm), the following relationship is satisfied:

$$0.5 < T < 3.5.$$

3. A fixing device according to claim 2, wherein said cover member includes a projected portion projecting toward said first rotatable member at the one end thereof.

4. A fixing device according to claim 1, wherein when a gap between said cover member and said first rotatable member is T (mm) and a peripheral speed of said first rotatable member is V (mm/sec), the following relationships are satisfied:

$$0.5<T<0.0059\times V+0.72, \text{ and}$$

$$115<V<200.$$

5. A fixing device according to claim 4, wherein said cover member includes a projected portion projecting toward said first rotatable member at the one end thereof.

6. A fixing device according to claim 5, wherein a width of said projected portion is broader than a width of an image formable region of a maximum width sheet usable in said fixing device.

7. A fixing device according to claim 1, wherein said first rotatable member is an endless belt, and said second rotatable member is roller configured to rotationally drive said endless belt.

8. A fixing device according to claim 7, further comprising a heater configured to heat said endless belt, wherein said heater is disposed inside said endless belt.

9. A fixing device according to claim 1, wherein said first rotatable member is provided in a side where said first rotatable member is contactable with said toner image.

* * * * *